United States Patent [19]

Zaremba

[11] 4,423,982

[45] Jan. 3, 1984

[54] METHOD AND EQUIPMENT FOR RUNNING RISER PIPES FOR MOORING OFFSHORE FLOATING PLATFORMS

[75] Inventor: Hubart B. Zaremba, London, England

[73] Assignee: Standard Oil Company (Indiana), Chicago, Ill.

[21] Appl. No.: 214,596

[22] Filed: Dec. 8, 1980

[51] Int. Cl.[3] ..... E02B 17/02; E21B 15/02

[52] U.S. Cl. ..... 405/195; 166/338; 166/367

[58] Field of Search ..... 405/169, 195; 166/338, 166/339, 345, 349, 350, 359, 366, 367; 175/7

[56] References Cited

U.S. PATENT DOCUMENTS

| | | | |
|---|---|---|---|
| 3,373,807 | 3/1968 | Fischer et al. | 166/345 X |
| 3,648,638 | 3/1972 | Blenkarn . | |
| 3,976,021 | 8/1976 | Blenkarn et al. . | |
| 3,983,828 | 10/1976 | Stram . | |
| 3,993,273 | 11/1976 | Dade . | |
| 4,062,313 | 12/1977 | Stram . | |
| 4,127,005 | 11/1978 | Osborne | 405/227 |
| 4,174,011 | 11/1979 | Zaremba | 175/7 |
| 4,199,275 | 4/1980 | Tuson | 405/195 |
| 4,214,842 | 7/1980 | Franks | 405/195 X |
| 4,228,857 | 10/1980 | Nobileau | 166/366 X |

*Primary Examiner*—David H. Corbin

*Attorney, Agent, or Firm*—John D. Gassett

[57] ABSTRACT

A system for running riser pipes from a floating vessel to each of a plurality of conductors set in the sea floor in a circular pattern. A vertically mooring guidance riser is first connected between the center of the pattern and the floating vessel. A permanent riser pipe is guided down to one of the conductors by use of a guide frame positioned on the guidance riser. When all of the permanent riser pipes are run, the guidance riser may be removed. Special running tools and guide frames are described.

3 Claims, 19 Drawing Figures

METHOD AND EQUIPMENT FOR RUNNING RISER PIPES FOR MOORING OFFSHORE FLOATING PLATFORMS

BRIEF SUMMARY OF THE INVENTION

This invention concerns a method and equipment for running riser pipes for mooring Vertically Moored Platforms or the like to anchors in the ocean floor. Riser pipes are large diameter steel pipes, e.g., 20 inches, which run between the floating platform and mating 20-inch conductor pipes set in the sea floor which serve as anchors. Drilling and production operations can be carried on through these conductor and riser pipes. The conductor pipes are normally drilled through a rectangular template set on the sea floor. Each corner of the template is typically provided with eight well slots which are arranged in a circle.

In this invention each corner of the template is provided with a center sleeve which is the center of the circle defined by the eight well slots. A special temporary vertical mooring riser is run between the floating vessel and the center sleeve with the lower end of the temporary mooring riser locked in a keyed anchor slot. The guidance riser is provided with external splines which are used for guiding or orienting a guide frame means which is movable along the guidance riser. The guide frame means includes a guide frame running tool which fits over the splined guidance riser, a guide frame which is attached to the running tool, and a guide clamp which is attached to the guide frame and is releasably connected to the riser pipe which is to be run. The riser pipe is made up of a large number of sections which may be 20 to 40 feet long, for example, and as new joints of riser pipe are added at the surface the guide frame means is lowered to lower the riser pipe being made up in a controlled manner until it reaches the selected conductor pipe which has already been set in the sea floor. When the lower end of the riser pipe reaches the conductor, automatic latching means are actuated to connect the riser pipe to the conductor in a sealing manner. This in effect extends the 20-inch conductor to the surface of the floating platform. At this point the guide clamp is released from the riser pipe just run and the guide frame means is raised to the floating platform. The guide clamp is then repositioned on the guide frame and another riser pipe is then run. This is repeated until each of the required riser pipes have been run in each selected well slot for each corner of the template.

In another embodiment of this invention, a plurality of spacer frames are supported on each corner of the template. These frames are stacked on the drilling template in their proper orientation before the template is lowered to the ocean floor. These spacer frames are circular and have the same number of peripheral clamping means as there are to be riser pipes run in each corner of the template. After all riser pipes have been run, e.g. eight in one corner of the template, a spacer frame running tool is provided on the guidance riser. Means are provided to selectively connect the spacer frame running tool to a selected riser spacer frame from the stack on the template. The frames are raised to proper position by raising the hydraulic running tool to the selected level, again utilizing the guidance system described above. The spacer frames are latched to the riser pipe at selected levels by hydraulically actuated clamps. The temporary vertical mooring and guidance risers may be left in place, or if not compatible to the planned operations, they may be removed.

DRAWINGS

A better understanding of the invention can be had from the following description taken in conjunction with the drawings in which.

Figure 14:
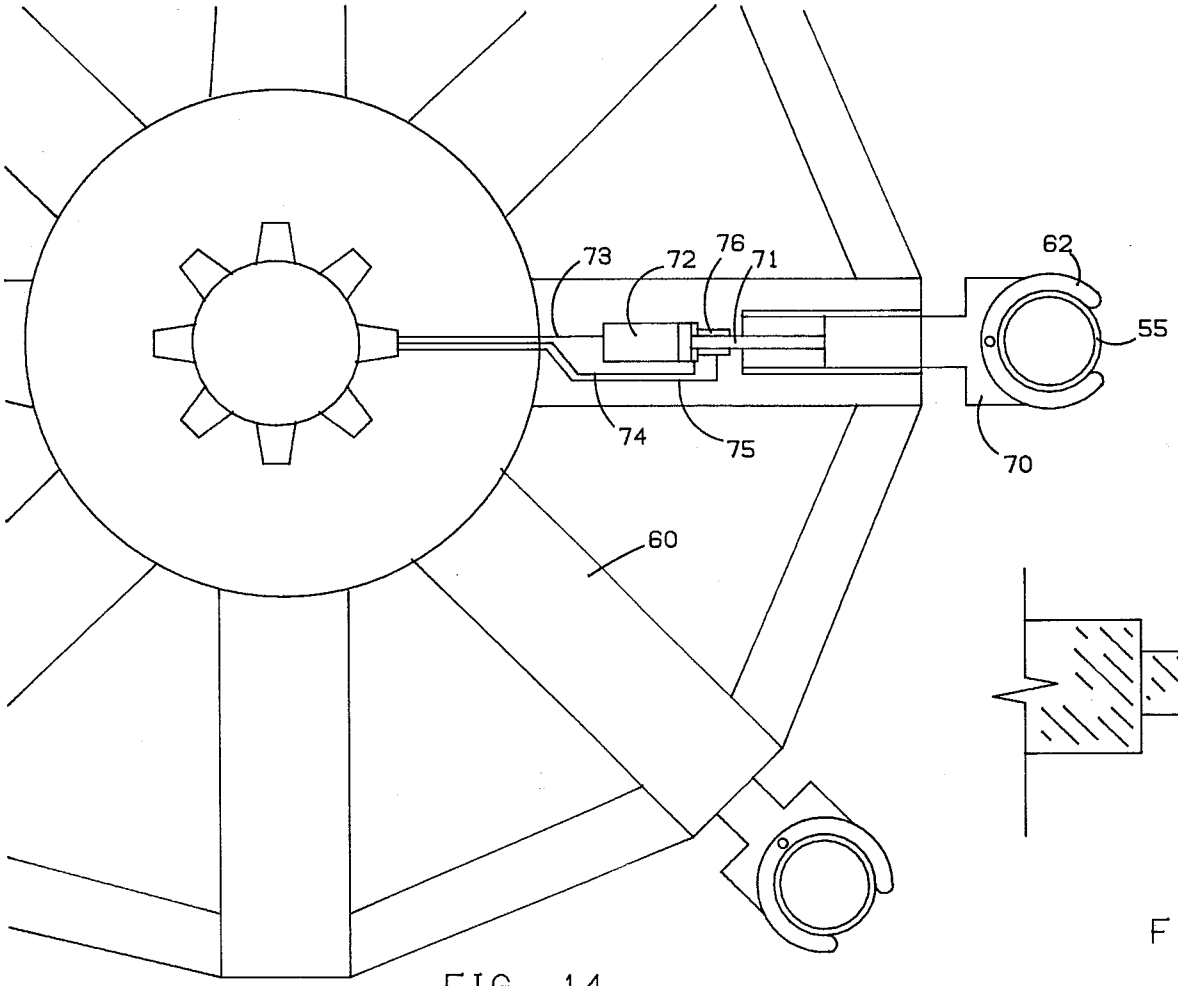

FIG. 14 schematically shows a part of a guide frame and its riser clamps and hydraulic control system.

Figure 15:
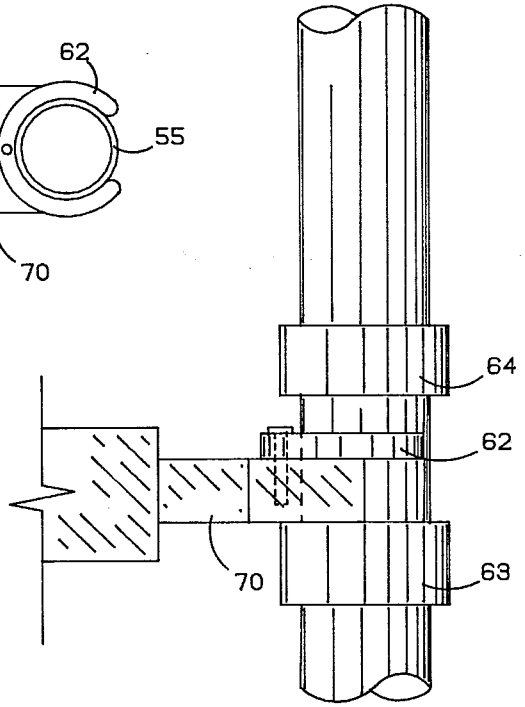

FIG. 15 illustrates the riser clamp in position on a riser pipe.

Figure 16:
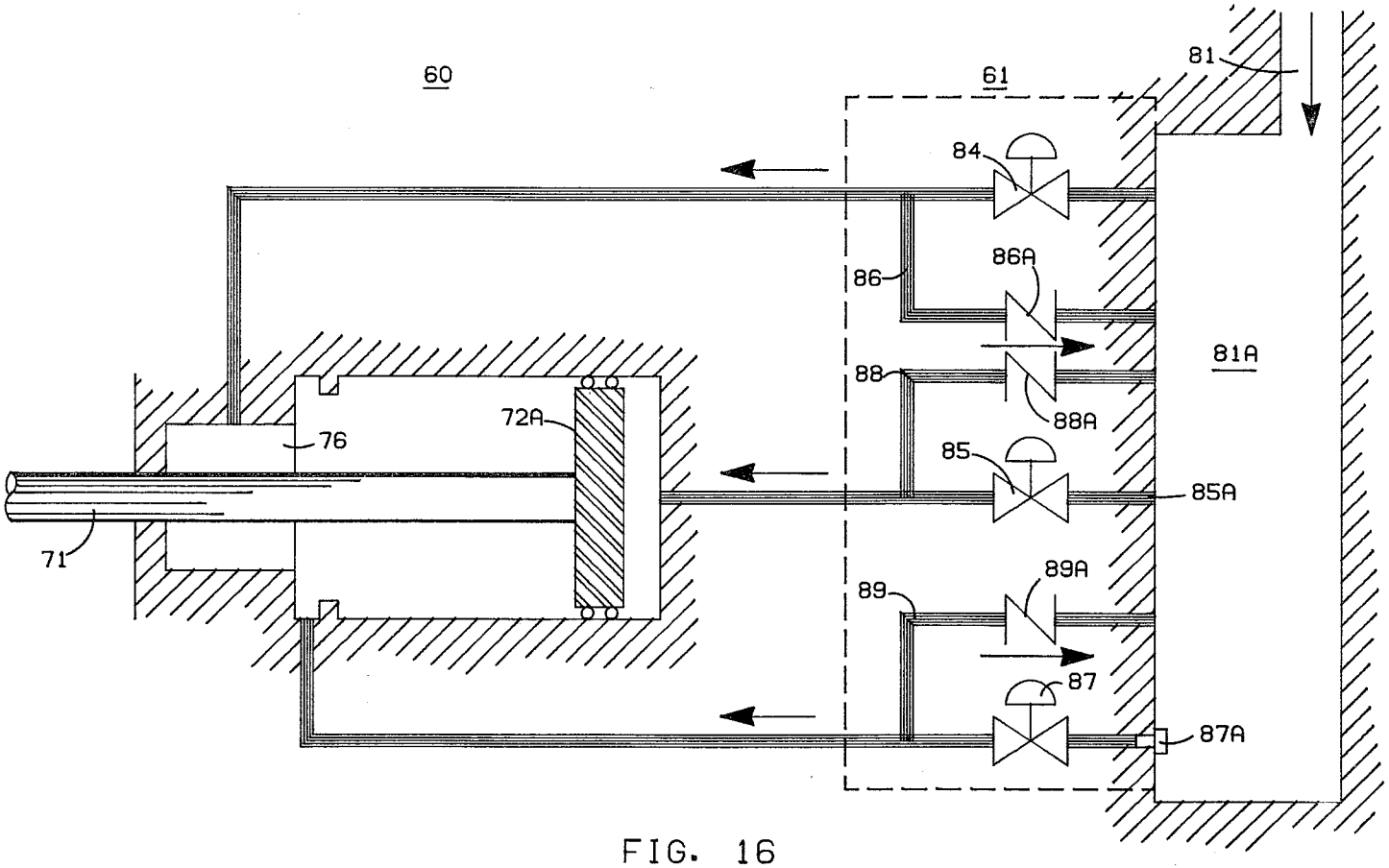

FIG. 16 illustrates the hydraulic control lines of the mechanism for equipment for closing and opening one of the riser clamps illustrated in FIG. 14.

Figure 17:
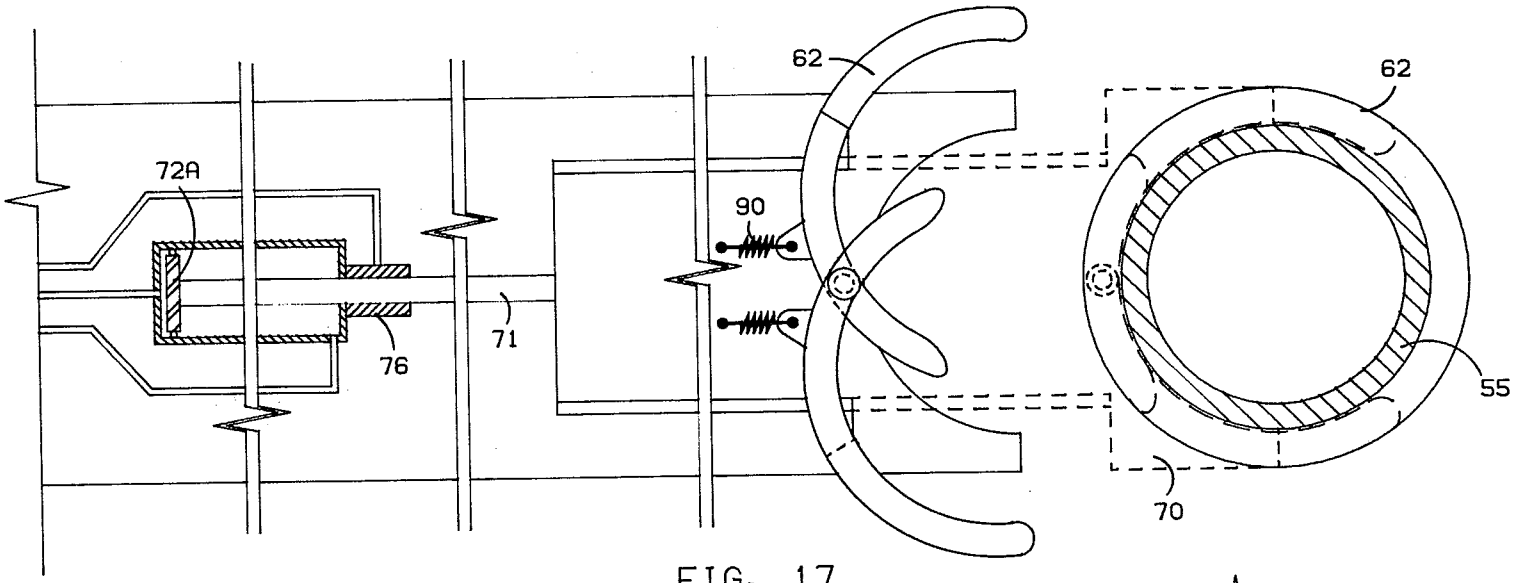

FIG. 17 illustrates the mechanism, including the clamps, for opening and closing the riser clamps about the riser.

Figure 18:
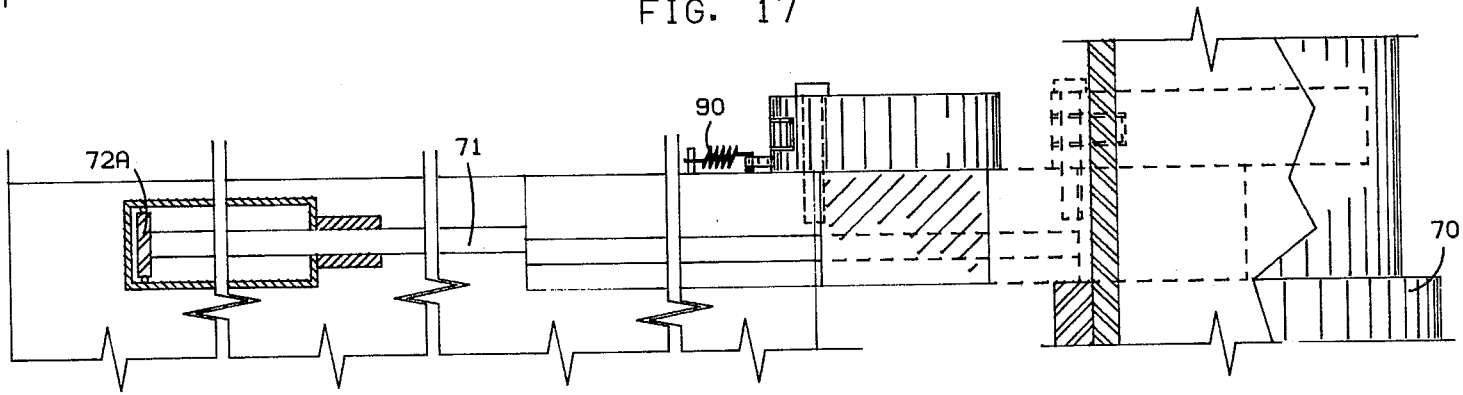

FIG. 18 illustrates a side view of the device in FIG. 16.

Figure 19:
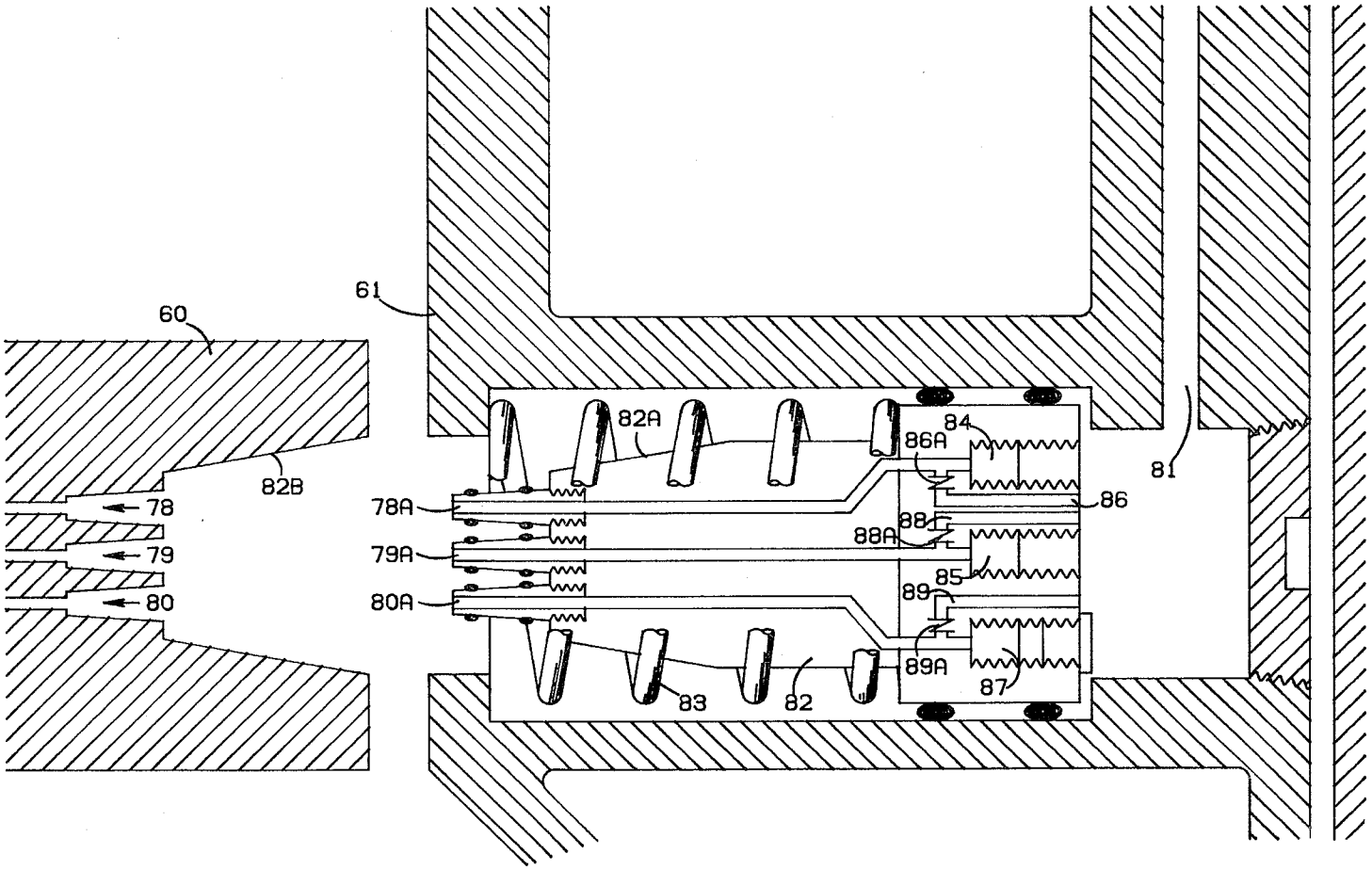

FIG. 19 illustrates the saber carried by the spacer running tool for engaging the hydraulic reciprocal of the riser spacer essential for opening and closing the riser clamps.

DETAILED DESCRIPTION

Figure 1:
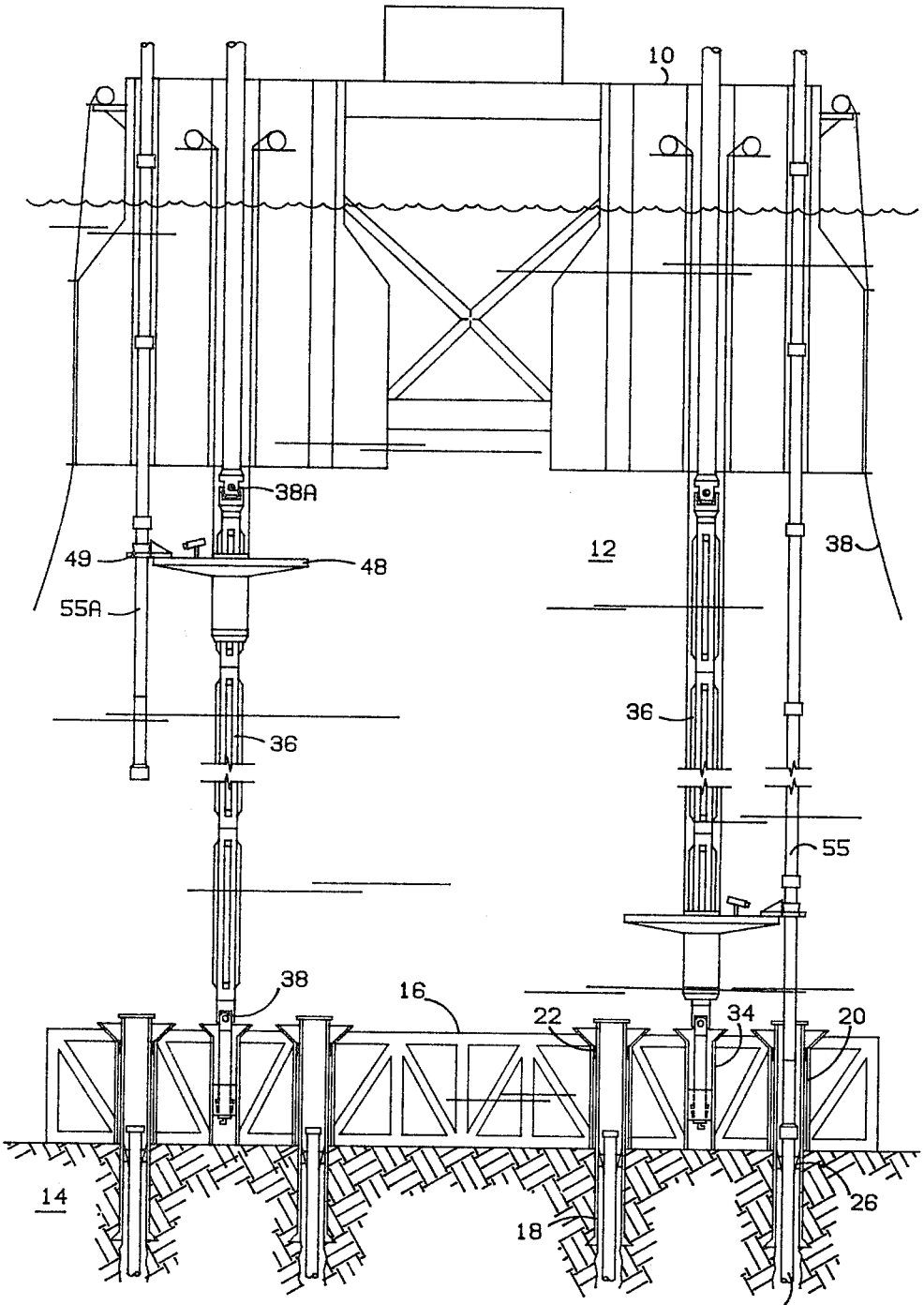
FIG. 1 illustrates a Vertically Moored Platform partially anchored by two installed temporary mooring guidance risers.

Attention is first directed to FIG. 1 which shows a floating platform 10 such as a Vertically Moored Platform floating on a body of water 12 above the base or the ocean floor 14. A sea floor template 16 is anchored to the ocean floor by a plurality of drive pipe 18. Drive pipes 18 are supported from well slots 20 of template 16 by casing hanger means 22. Mounted within each drive pipe 18 is a conductor 24 which are supported therefrom by casing hangers 26. (This arrangement is shown more clearly on FIG. 3.)

Figure 2:
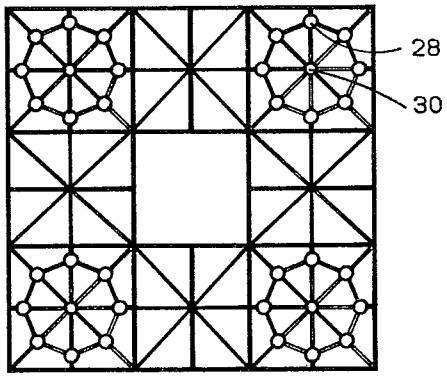
FIG. 2 illustrates a plan view of a subsea template showing well slots in each corner.
Figure 3:
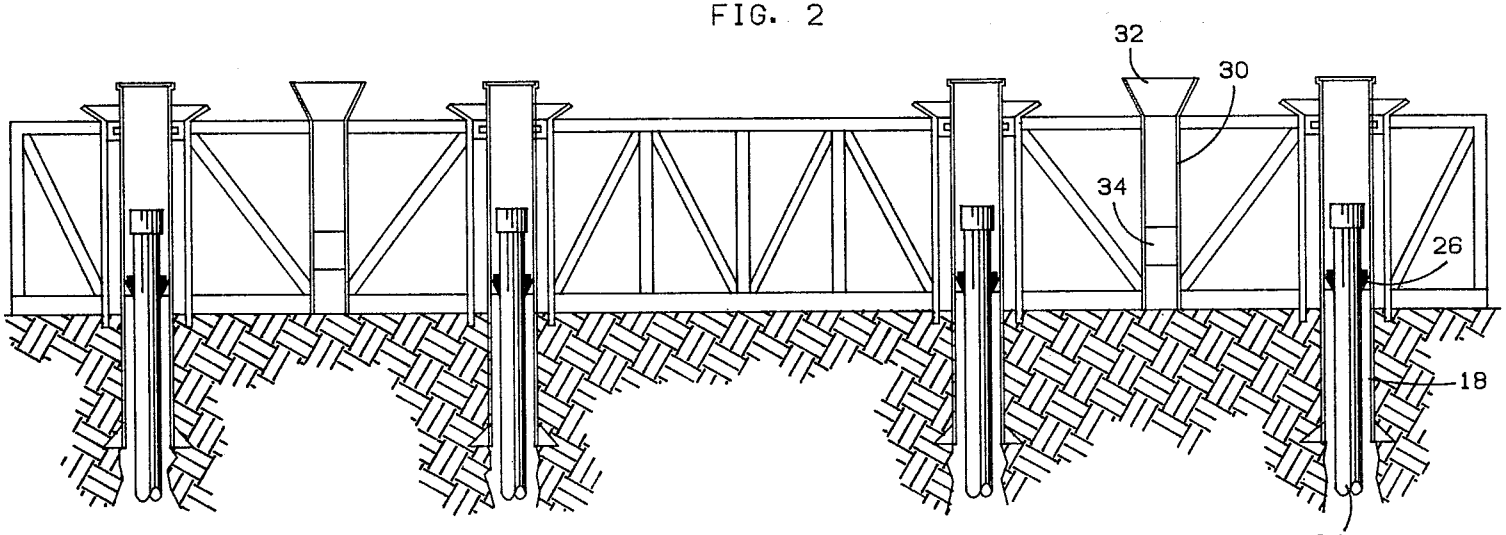
FIG. 3 illustrates a typical side view of a subsea template showing vertical well slots and associated set conductors.

A top view of the template is shown in FIG. 2. This is illustrated as being a square configuration in which there is a pattern of well slots in each corner. Other patterns could be selected. Each corner is shown to have 8 wells slots 28 which are arranged in a circle about a center sleeve 30. As indicated in FIG. 3, center sleeve 30 is provided with a funnel 32 and an anchor section 34 which will be described more completely in FIG. 5. Referring back to FIG. 1 there is shown two vertical mooring guidance risers 36 which connect anchor section 34 of template 16 to the Vertically Moored Platform 10. There is one such guidance riser in each center sleeve of each corner of the template illustrated in FIG. 2. These vertical mooring guidance risers 36 form a large part of the initial anchoring of the Vertically Moored Platform 10. Also forming a part of the temporary anchoring system are anchor lines 38 which extend to anchors not shown which are some horizontal distance from Platform 10, e.g., 500 to 1000 feet.

Figure 4:
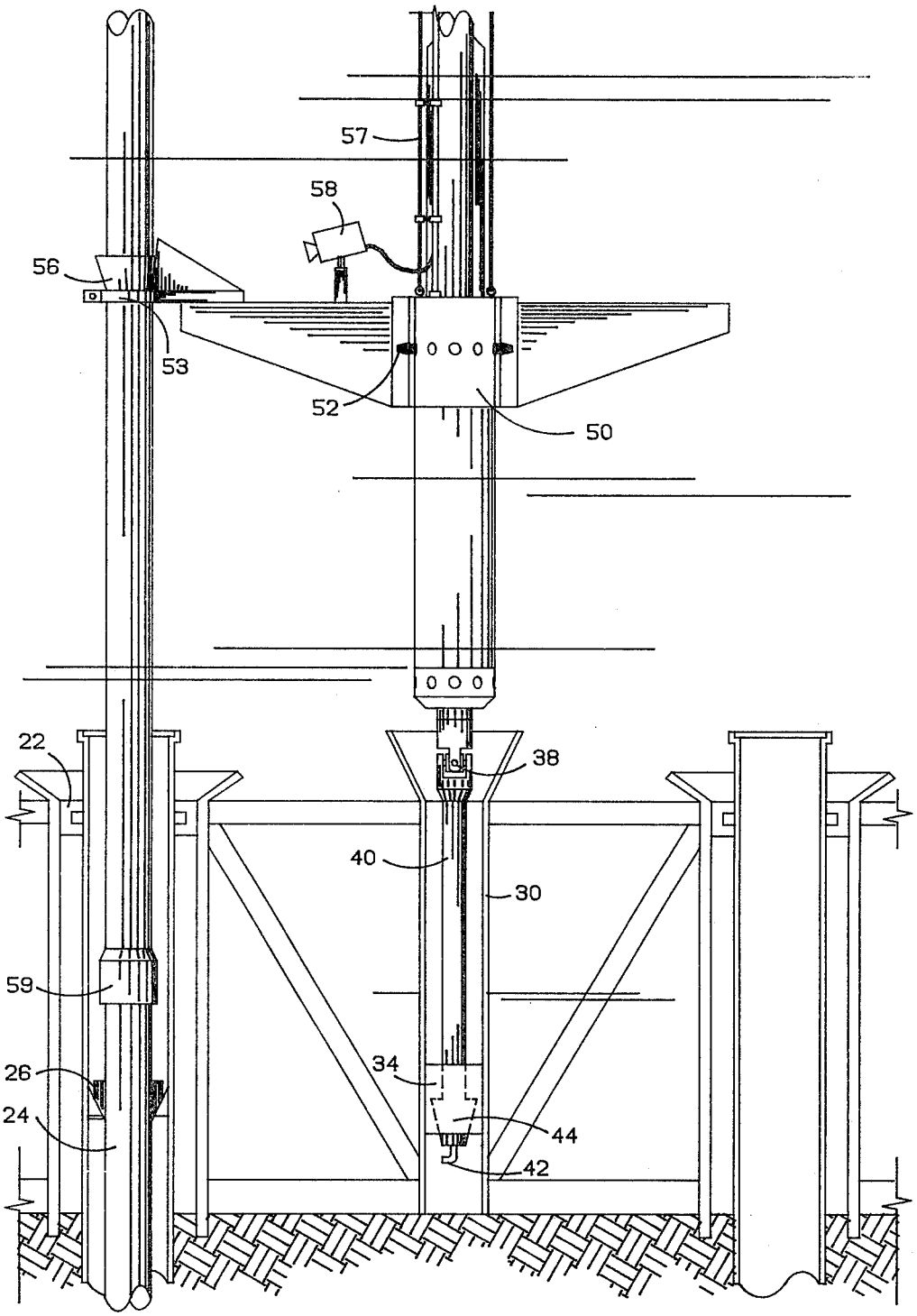
FIG. 4 illustrates an enlarged view of the guide frame running means and the lower end of the temporary mooring guidance riser shown in FIG. 1.

As shown in FIG. 4, the lower end of each vertical mooring guidance riser 36 is provided with a ball joint 38 connected to an anchoring section 40 which is provided at the lower end with a positioning jet 42 and anchor dogs 44 which are spaced 180° apart. Guidance riser 36 can be directed into center sleeve 30 in a known manner using positioning jet 42 and subsea cameras as may be necessary.

Figure 5:
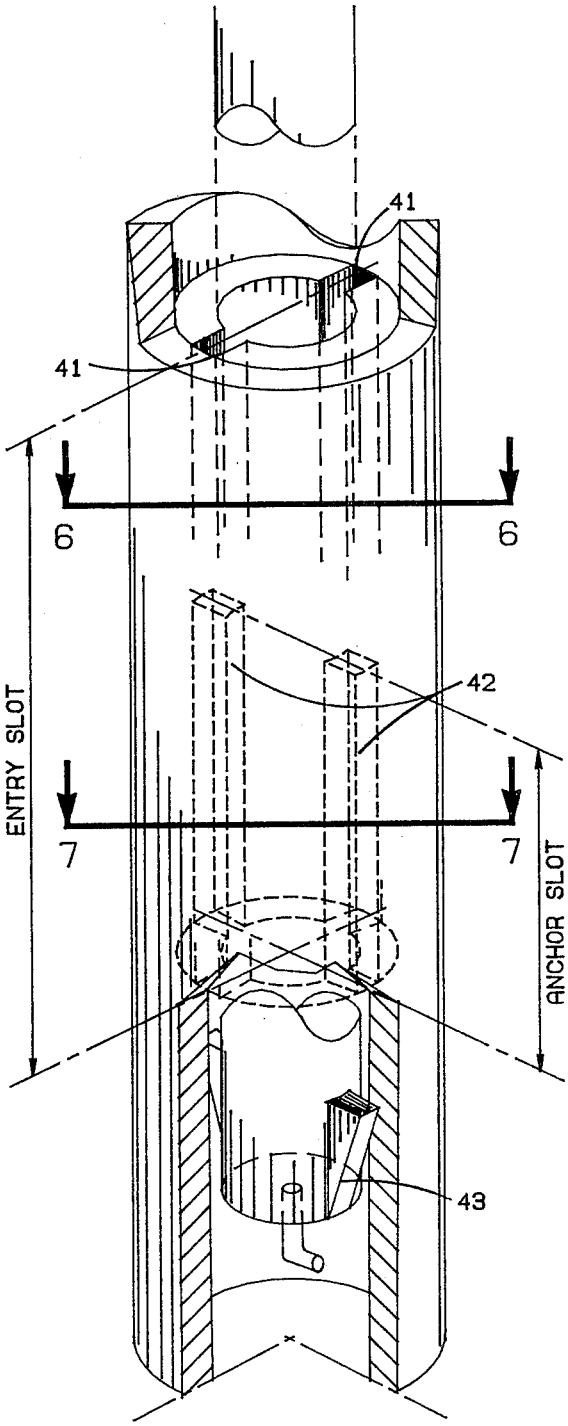
FIG. 5 illustrates the keyed anchor section of the center sleeve of FIG. 4.
Figure 6:
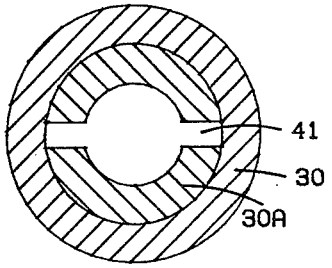
FIG. 6 is a section along the line 6—6 of FIG. 5.
Figure 7:
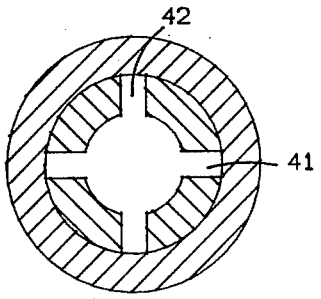
FIG. 7 is a section along the line 7—7 of FIG. 5.

Keyed anchor slots are shown more clearly in FIG. 5, 6 and 7. There is an entry slot section which has slots 41 180° apart. These extend substantially the entire length of the anchoring portion of sleeve 34. The lower part of the anchoring part has anchor slots 42 which extend up about half way of the length of the entry slots 41 and are spaced at 90° with respect to entry slots 41. In operation, the anchoring section 40 at the lower portion of guidance riser 36 is provided with anchor dogs 43 which are 180° apart. Slot containing mandrel 30A can be welded within sleeve 30. Section 40 is lowered so that anchor dogs 43 pass down through slots 41. When the dogs 43 have passed through the anchoring section of sleeve 34, the pipe is rotated 90° and then pulled up through the anchoring slots 45. As long as tension is maintained on the guidance riser 36, it remains anchored in the anchor slots 42.

The upper ends of mooring guidance risers 36 are anchored to the Vertically Moored Platform. This can be done in a manner such as described in U.S. Pat. No. 4,127,005, "Riser/Jacket Vertical Bearing Assembly for the Vertically Moored Platform," Bodwell D. Osborne, inventor, issued Nov. 28, 1978. Inasmuch as the method is known, it need not be described in detail herein.

Ball joints 38 are provided at the lower end of the mooring guidance riser and ball joints 38A are provided at the upper end.

Figure 8:
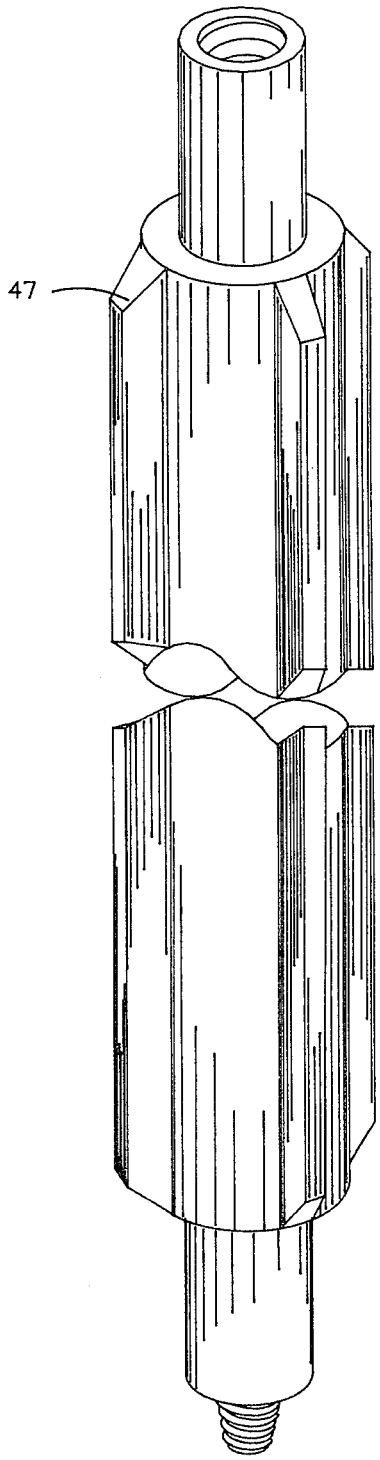
FIG. 8 illustrates a section of the splined vertical temporary mooring guidance riser.

FIG. 8 illustrates an isometric view of one joint of the vertical mooring guidance riser 36. It has a plurality of splines 47 and is provided with a box joint at one end and a pin end at the other.

Guide frames 48 with riser clamps 53 are provided on each vertical mooring guidance riser 36. This can be more clearly seen in reference in FIGS. 4, 9, and 10. Shown thereon is a guide frame running tool 50 connected to a guide frame 48 by latching cams 52. Mounted on the outer end of guide frame 48 is a split guide clamp 53 connected by shear pin 54 at the outer end. A permanent riser pipe 55 is provided with a shear wedge 56. Clamp 53 supports wedge 56 and is used for lowering the riser pipe 55 into the position shown in FIG. 1. Lowering and raising cables 57 are provided guide frame running tool 50. A TV camera 58 is also provided on frame 48 to provide a view of guide clamp 53. In operation, riser 55 is lowered by lowering guide frame running tool 50 with cables 57 until sufficient length of riser pipe 55 has been made up by adding joints at the surface until the lower end of riser pipe 55 is in contact with the latching means 59 which is connected to the upper end of conductor 24 which usually will have been cemented in place. Latching means 59 can be any auto connecting means which will withstand the desired pressure and provide the necessary sealing. After riser 55 has been connected to conduit 24 by connector 59, one wishes to pull the guide frame 48 back to the floating platform so that another riser pipe can be lowered. In order to do this, force is applied on cables 57, causing shear pin 54 to shear. After the pin is sheared, the split clamp opens and slides up over wedge 56. As can be seen in FIG. 1, the riser pipe 55 has been connected to the conductor 24, whereas the vertical mooring guidance riser 36 is in position but the permanent riser pipe 55A, on the left side of the figure, is in the process of being lowered.

Figure 11:
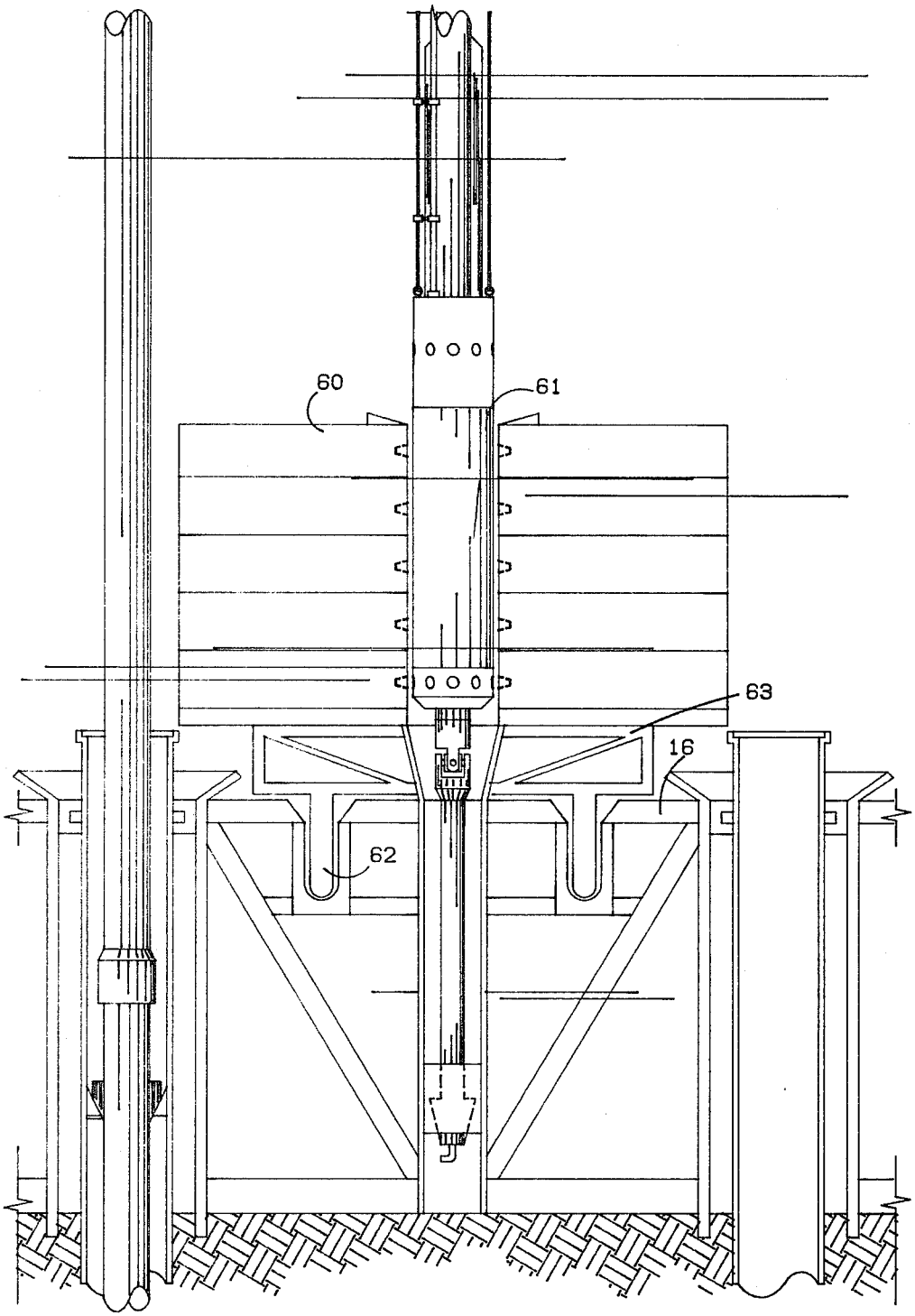
FIG. 11 illustrates prestacked riser spacer frames mounted on a carrying pallet on one corner of the template of FIG. 3.

I have just described apparatus and method for using temporary vertical mooring guidance riser 36 for lowering riser pipes 55 to permanently anchor the Vertically Moored Platform 10 with the conductors 24. When this is completed the temporary catenary lines 38 are removed in the case of a Vertically Moored Platform. The temporary vertical mooring guidance risers 36 can be removed if desired or they can be left in position. However, in many cases it is desired to provide spacer frames holding the riser pipes 55 in a relatively fixed position with respect to each other. If this is desired, then before temporary vertical mooring guidance risers 36 are removed, I use them in this embodiment to position the riser spacer frames. As shown in FIG. 11 I prestack a layer of spacers 60 on carrying pallet 63, which is provided with posts 62 which fit into receptacles provided on the template 16. A spacer frame running tool 61 is provided about the temporary mooring guidance risers 36.

Figure 12:
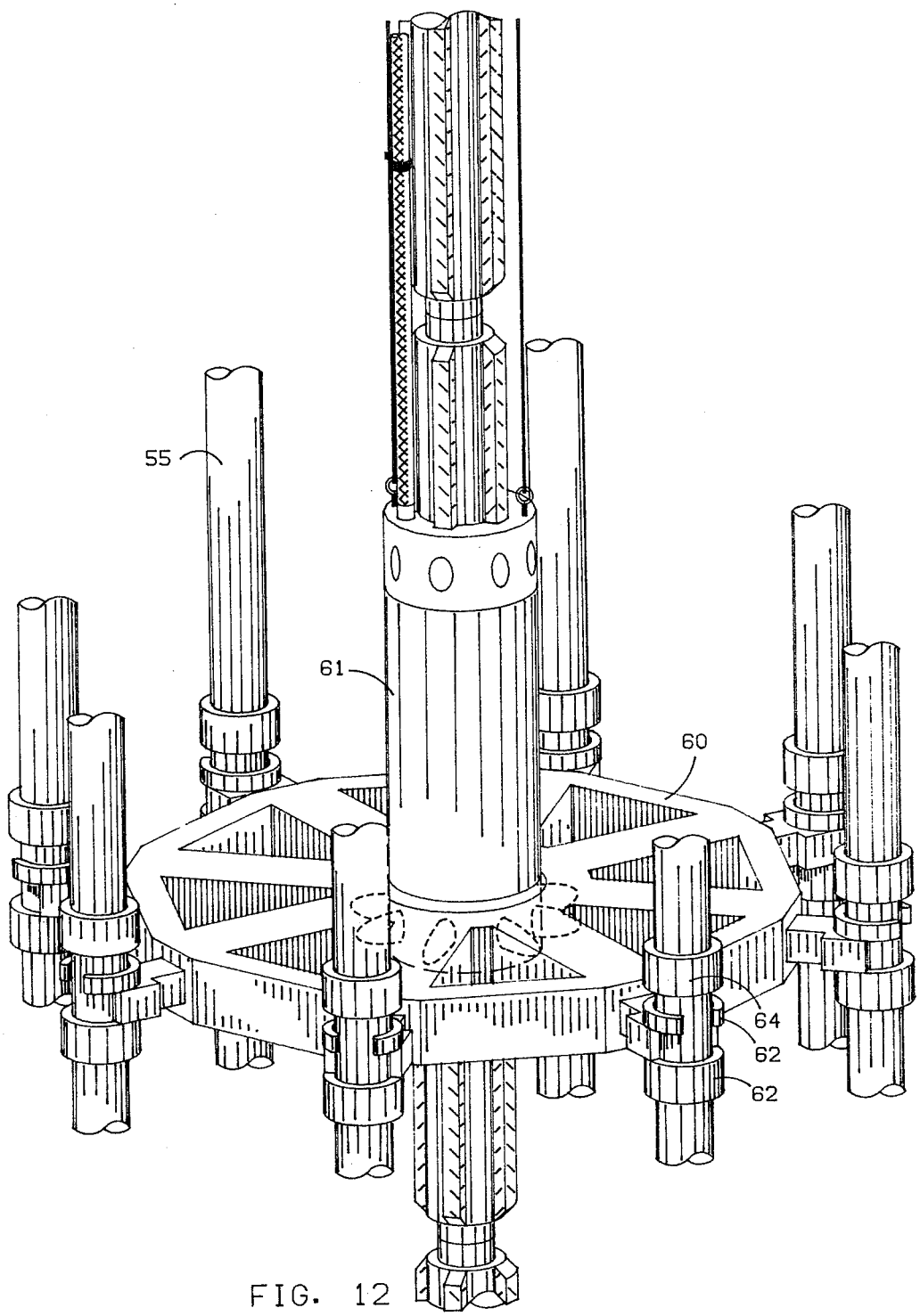
FIG. 12 illustrates a riser spacer frame engaging the risers and being positioned by a guide frame running tool.

FIG. 12 clearly shows a riser spacer frame 60 connected to riser pipes 55. The spacer frame running tool 61 has carried the spacer frame 60 to the desired position and clamps 62 are shown actuated about riser pipes 55 between shoulder 63 and 64.

Figure 13:
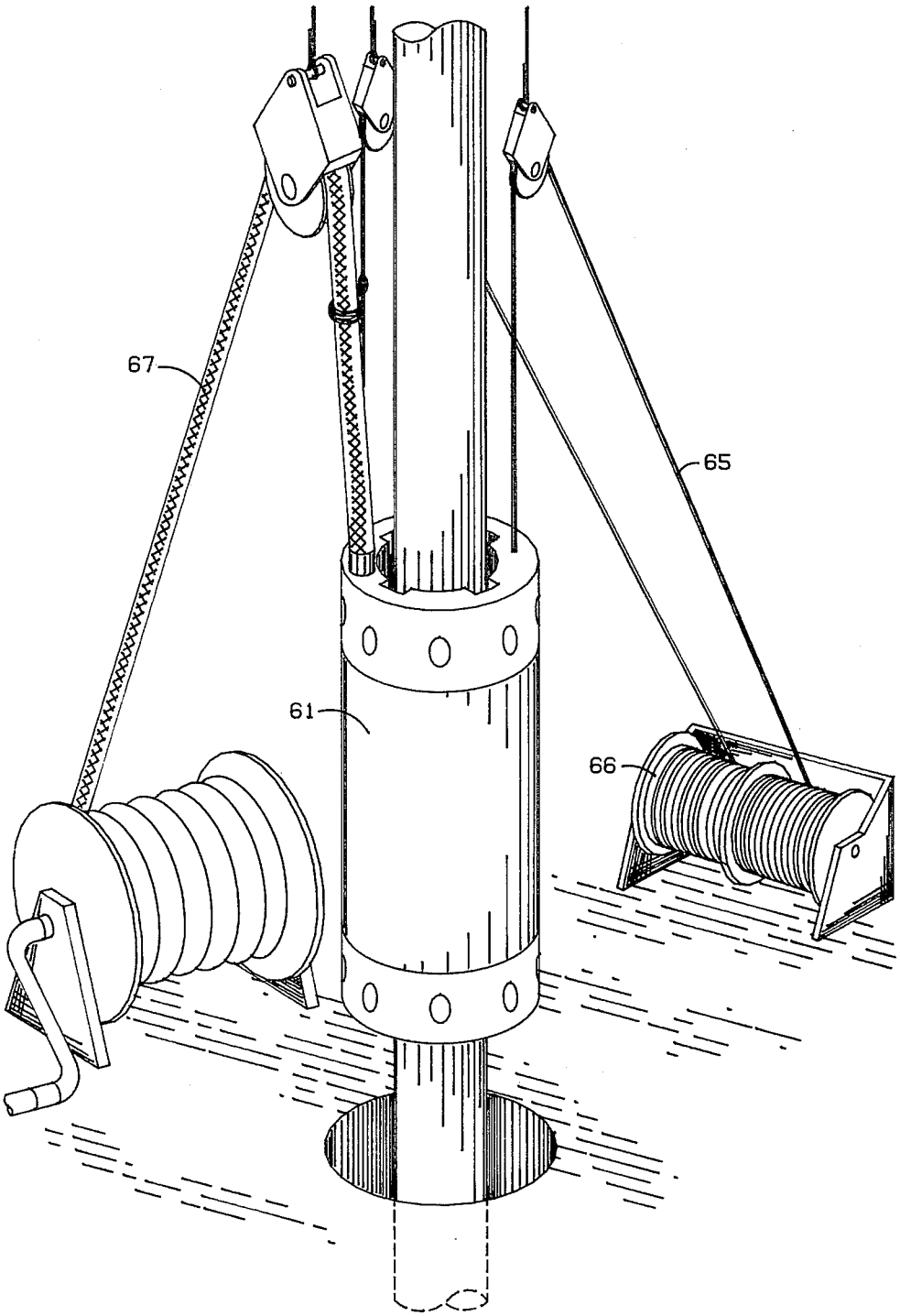
FIG. 13 illustrates hydraulic control line and lowering winches for controlling the running tool for both the guide frame for carrying the riser pipe for guiding the riser spacer frames.

FIG. 13 illustrates running tool 61 which can be raised and lowered by cable 65, and controlled by winches 66. Hydraulic control lines are indicated by numeral 67, which may represent a bundle of control lines. Means will also be discussed as to how to release the running tool 61 from spacer frame 60.

Attention is next directed to FIGS. 14 and 15. FIG. 14 shows schematically the hydraulic control system for opening, extending, and closing and retracting clamps 62. A support ram 70 is connected through rod 71 to a piston in cylinder 72. A first hydraulic line 73 drives the cylinder to extend piston rod outwardly and a second line 74 drives cylinder 72 to retract rod 71. A third line 75 is connected to a clamp means 76 to cause it to maintain rod 71 in any position that it is when clamp means 76 is actuated. Clamp 76 can be a Bear-Loc which is an infinite position mechanical locking device sold by York Industries, Inc. There is provided comparable hydraulic control systems for each of the risers served by spacer 60.

Attention is next directed to FIG. 19. It will be noted that, once latched to risers 55, spacer frames 60 are left in place and the spacer frame running tool 61 is removed to some other position. I will next discuss a way of aligning the conduit control lines of the spacer frame 60 with the fluid control lines carried by the running tool 61. Shown in FIG. 19 are receptacles 78, 79, and 80 in spacer frame 60. Aligned with those receptacles are saber conduits 78A, 79A, and 80A carried by latching cam 82, which has a surface 82A which complements the surface 82B in frame 60. Each saber is provided with the proper seals and having a sloping surface which complements the interior surface of receptacles 78, 79, and 80. When it is desired to activate the clamping and releasing controls of the spacer frame 60, running tool 61 is lowered to the same level as clamp 60 so that sabers 78A, 79A, and 80A are approximately aligned with receptacles 78, 79, and 80. The application of pressure in the interior of conduit 81 within the spacer running tool 61 forces the housing 82 carrying saber 78A, 79A, and 80A to the left until the sabers are in receptacles 78, 79, and 80, respectively, and sealing engagement therewith. If pressure is lowered sufficiently within cavity 81A which is connected to conduit 81, spring 83 forces housing cam 82 inwardly into the position shown in FIG. 19. The head of housing 82 is provided with sealing means forming a piston. This head is provided with valves 84, 85, and 87. These valves can be individually set to open only upon the pressure in cavity 81A increasing to a selected pressure. Each such valve is provided respectively with a bypass 86, 88, and 89, each containing a check valve 86A, 88A, and 89A, respectively. For an explanation of how these valves function, attention is directed to FIG. 16. Check valves 86A, 88A, and 89A permit flow only in the directions indicated by the arrows, i.e., toward cavity 81A. By properly selecting the pressures at which valves 84, 85, and 87 open and by plugging the proper conduit port 85A or 87A at the surface before running the tool, one can set or open the riser clamps 62 in an extended or closed position. I shall now describe the operations for closing clamp 62 on riser 55. I position a hydraulic riser running tool 61 in the riser spacer frame. Before I lower the tool I put in plug 87A so that no fluid pressure would be applied to control control valve 87. I can, if I desire, remove saber 80A inasmuch as it will not be used in this operation. I then pressure up the inside of the running tool to a selected pressure, e.g. 100 lbs, which will force the piston 82 outwardly so that sabers 78A and 79A, as shown in FIG. 19, are aligned and are inserted in sealing engagement with receptacle 78 and 79. Pressure valves 84 and 85 are set at a higher pressure so that they will not open at the lower pressure that is required to move housing cam 82 outwardly to set sabers 78A and 79A. By way of example, I have set the opening pressure on valve 84 to be approximately 1000 lbs. I then increase the pressure in the conduit 81 inside the running tool 61 to approximately 1500 psi, which is sufficient to open the Bear-Loc clamp 76 on rod 71. Up to this point the valve 85 has not opened. It is set to open at a pressure of 1500 psi or greater, so I increase the pressure to 2000 lbs, for example, which is greater than its opening pressure of valve 85. When this is opened it causes piston 72A within cylinder 72 to move to the left, driving piston rod 71 to its extended position. As shown in FIGS. 17 and 18, if I drive rod 71 to its extended position, clamps 62 are carried by ram 70 to engage riser 55. I then release the pressure to zero within conduit 81 and the Bear-Loc clamps on rod 71 are engaged to hold the rod 71 in its extended position until activated to release. Reducing the pressure in conduit 81 causes the housing 82 of FIG. 19 to retract in the position shown. Springs 90 are used to open clamps 62 when rod 71 is moved to its retracted position. Running tool 61 may then be moved to any position desired. If I wish to release the clamps 62 from the riser, I will plug conduit 85A and actuate the tool so that sabers 78A and 80A are engaged in receptacles 78 and 80. I then increase the pressures so that clamp 76 is released and pressure is then applied through valve 87 to drive piston 72A to its right or retracted position. Check valves 86A, 88A, and 89A are provided to relieve the pressure or fluid which may build up downstream of pressure control valves 84, 85, and 87. It is seen that when pressure in conduit 81 is reduced to zero, then the pressure in these conduits 86, 88, and 89 is also reduced to essentially zero. The pressures given above at which the various pressure control valves open are merely representative to illustrate the principle involved.

Figure 9:
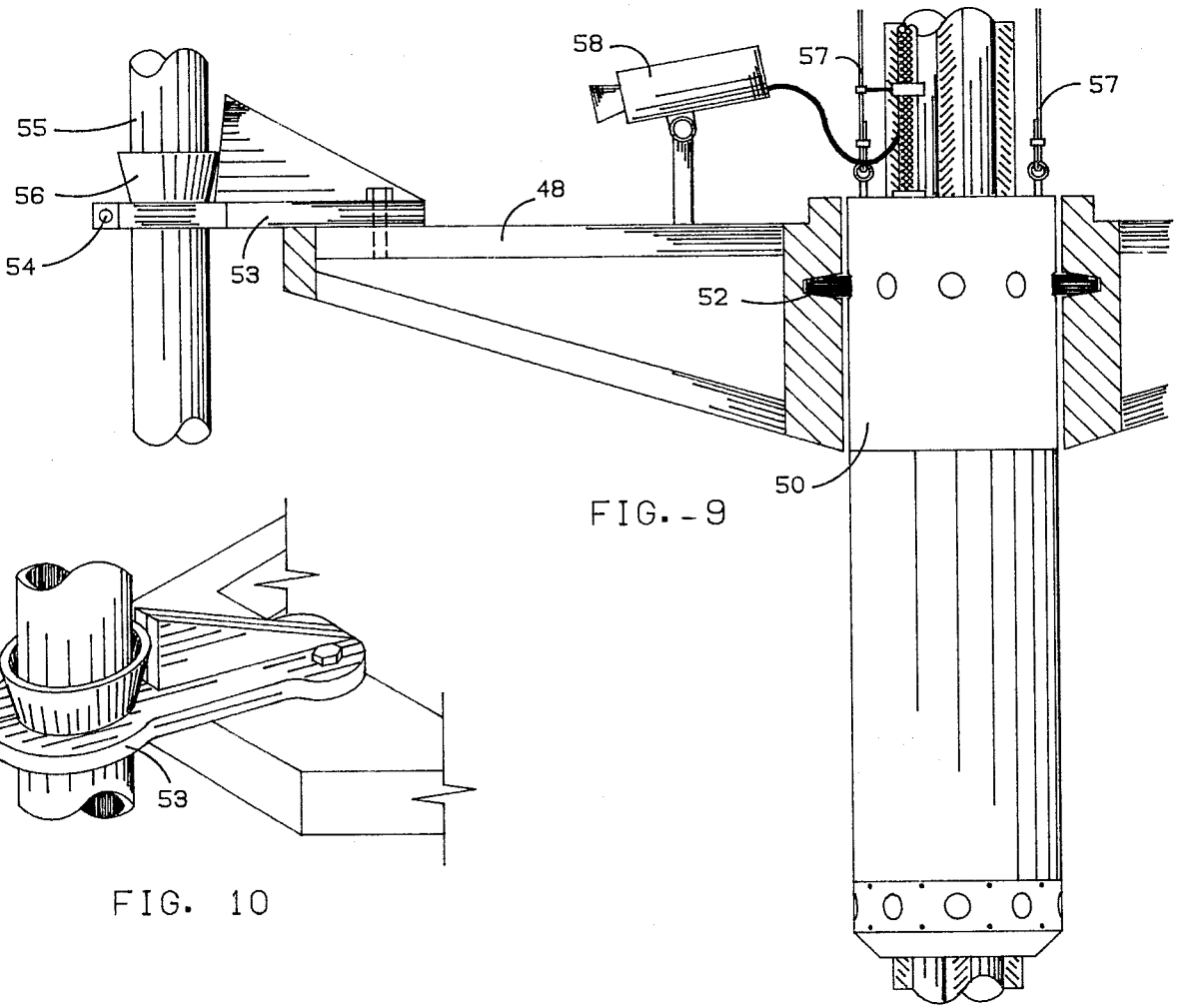
FIG. 9 illustrates an enlarged view of the running tool, guide frame, and riser clamp of FIGS. 1 and 4.
Figure 10:
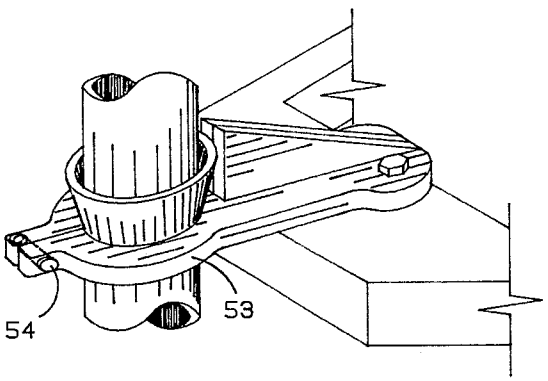
FIG. 10 is an isometric view of the riser clamp shown in FIG. 8.

In summary, then in the open position, the clamp 62 and ram 70 are retracted into the spacer frame body. The closing or clamping operation is actuated by hydraulic piston 72A, pushing the ram and clamp out of the frame until it engages the riser connector. All eight (or less, depending on the site) of the clamps are actuated simultaneously after the spacer frame is positioned on the riser at the desired location by the running tool. The riser spacer frames from the stacked deck on the template, as shown in FIG. 9, can be positioned in this manner at the desired location.

It is thus seen that by selectively plugging the inlets to valves 84, 85, and 87 and lowering or raising the running tool 61 to the proper spacer frame that any one riser can be either latched or unlatched independently from the spacer frame 60. Running tool 61 is oriented with respect to the vertical mooring guidance riser 36 can be made from a riser pipe which can be 10" O.D. and 4" I.D. with a matching guide spline 47 welded thereon. The running tool 61 then slides up and down over the guide spline 47 as shown in FIG. 12. Thus, by knowing the orientation of running tool 61 and its level about guidance riser 36, the exact position of each of the housing cams 81 carrying pressure saber 78A, 79A, and 80A is known. Thus, by presetting the running tool, any specific one or more of the eight clamps about the riser frame can be actuated (opened or closed) without disturbing the remaining clamps. Thus, if a riser needs to be removed for any reason, the clamp on each of the spacer frames latched to that specific riser can be opened sequentially by running and operating the preset running tool at each spacer frame.

If any spacer frame has to be repaired, it can be raised to the operating draft of the Vertically Moored Platform jacket for servicing or replacement of parts. However, all spacer frames in place above the one to be serviced must be sequentially released and hung under the jacket leg. The frame to be worked on is then retrieved on the running tool and suspended under the jacket leg while divers either effects repairs directly or dismantle components for repair on the deck of the Vertically Moored Platform.

While the above embodiments and operations have been described in detail, various modifications could be made therefrom without departing from the spirit or scope of the invention.

What is claimed:

1. A method of running risers from a floating vessel to each of a plurality of conductors set in the sea floor in a circular pattern which comprises:

running a vertically mooring guidance riser with alignment splines along its entire length between the floating vessel and the center of said pattern and anchoring the lower end thereof;

positioning a guide frame, having a guide clamp and guide frame running tool about said mooring guidance riser;

using said guide frame and guide frame running tool to guide a riser pipe from the floating vessel to one of said conductors by lowering said guide frame along the length of said guidance riser and latching the lower end of said riser pipe to said conductor;

raising the guide frame and guide frame running tool to the floating vessel, moving said guide clamp from one radial position on said guide frame with respect to said guidance riser to a second radial position and then guiding a second riser pipe from said vessel to a second of said conductors.

2. An anchoring and riser guidance system for a floating platform having a rectangular shape in which there is a circular pattern of riser pipe passages in each corner of said platform which comprises:

a template positioned on the sea floor beneath said platform and having approximately the same shape as said platform, there being a circular pattern of well slots in each corner of said template corresponding to the circular pattern of vertical passages for said riser pipes in said platform;

a center sleeve in each corner of said template located at the center of said circular pattern of well slots, there being a keyed anchor slot in said center sleeve;

a vertical mooring guidance riser connected between said keyed anchor slot and a position on said platform corresponding to the center of said circular pattern of vertical riser pipe openings, the exterior of said vertical mooring guidance riser being provided with oriented guiding splines, said vertical mooring guidance riser being maintained under tension by surplus buoyancy in said platform;

a guide frame mounted over said vertical mooring guidance riser and having internal splines complementing the splines of said vertical mooring guidance riser;

means to lower and raise said guide frame along said vertical mooring guidance riser;

a guide clamp on the outer end of said guide frame for guiding a permanent riser pipe from said platform to one of said well slots;

mooring lines extending from said platform laterally to anchors in the ocean floor.

3. An apparatus as claimed in claim 2 for use with a permanent riser pipe having a downwardly facing wedge at the lower end thereof and in which said guide clamp includes a split ring held together by a shear pin at the outer end thereof.

* * * * *

UNITED STATES PATENT AND TRADEMARK OFFICE

CERTIFICATE OF CORRECTION

PATENT NO. : 4,423,982

DATED : January 3, 1984

INVENTOR(S) : Hubart B. Zaremba

It is certified that error appears in the above—identified patent and that said Letters Patent is hereby corrected as shown below:

Column 5, line 45, "100 lbs" should read --1,000 lbs--.

Signed and Sealed this

*Fifth* Day of *February 1985*

[SEAL]

*Attest:*

DONALD J. QUIGG

*Attesting Officer* *Acting Commissioner of Patents and Trademarks*